United States Patent [19]

Wartian

[11] Patent Number: 4,520,639

[45] Date of Patent: Jun. 4, 1985

[54] DOUBLE DEAD BOLT DOOR LOCK

[75] Inventor: George Wartian, Detroit, Mich.

[73] Assignee: Wartian Lock Co., St. Clair Shores, Mich.

[21] Appl. No.: 447,235

[22] Filed: Dec. 6, 1982

[51] Int. Cl.[3] ..... E05B 65/06

[52] U.S. Cl. ..... 70/110; 70/139; 292/221

[58] Field of Search ..... 292/5, 7, 221, 226, 292/227; 70/107, 110, 111, 139

[56] References Cited

U.S. PATENT DOCUMENTS

| | | | |
|---|---|---|---|
| 1,593,667 | 7/1926 | Murmann | 70/110 |
| 3,115,357 | 12/1963 | Kubik | 70/107 |
| 3,783,658 | 1/1974 | Wada | 70/110 |

*Primary Examiner*—Robert L. Wolfe

*Attorney, Agent, or Firm*—Barnes, Kisselle, Raisch, Choate, Whittemore & Hulbert

[57] ABSTRACT

A latch and lock mechanism having a pivoted latch and means for retracting the latch. A dead bolt is also provided. A rotatable bolt actuator has a pin and slot connection with the bolt to move the bolt to its extended, locking position. The bolt actuator also has means for simultaneously blocking retraction of the latch to provide in effect a double dead bolt lock.

9 Claims, 19 Drawing Figures

DOUBLE DEAD BOLT DOOR LOCK

This invention relates generally to latch and lock mechanisms and refers more particularly to a double dead bolt latch and lock mechanism for storm and screen doors and the like.

SUMMARY OF THE INVENTION

Providing a dead bolt for a door lock mechanism is well known. However, this invention involves the provision of a bolt actuator for extending the bolt to its locking position having means operative at the same time to positively lock the latch in its operative position, thereby providing in effect a double dead bolt lock.

In the latch and lock mechanism about to be described, a latch is pivoted on the housing and when in operative position is engageable with a keeper to maintain the door closed. An operator is provided to withdraw the latch from operative position in order to release it from engagement with the keeper, permitting the door to be opened. A bolt is mounted for movement from an operative locking position to a retracted position. Means are provided for positively locking the bolt and the latch in their operative positions.

More specifically, the means for positively locking the bolt and latch in their operative positions comprises a bolt actuator moveable to extend and hold the bolt in its operative position and having means for simultaneously blocking the retraction of the latch. These and other objects and features of the invention will become more apparent as the following description proceeds, especially when considered with the accompanying drawings.

DETAILED DESCRIPTION

Figure 1:
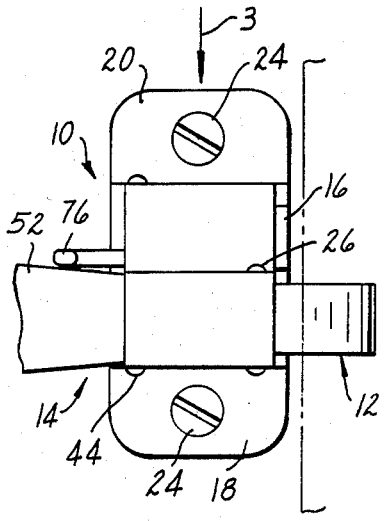
FIG. 1 is an elevational view of the door latch and lock mechanism of my invention shown mounted on the inner side of a door.

Referring now more particularly to the drawings and especially to FIGS. 1–13 thereof, the door latch and lock mechanism there shown has a housing 10, a latch 12, a latch operator 14, a dead bolt 16, and a bolt actuator 17.

The housing 10 has a mounting portion 18 formed by a plate 20 having a marginal flange 22 extending at right angles to the plate and adapted to bear against the inner surface of the door 23 when mounted thereon adjacent to the swinging edge thereof by fasteners 24, as shown.

The latch 12 is pivotally mounted in the housing by a vertical pin 26. The latch has a latching arm 28 formed with an arcuate peripheral edge portion 30 adapted to engage the keeper slot 32 in a fixed door jamb 34. The latching arm 28 is relieved along one side where indicated at 36 to receive the operating arm of the latch operator 14, as more fully described hereinafter. The latch 12 has a second arm 38 at a substantial angle to the camming edge 40 of the latching arm which is engaged by a compression coil spring 42 mounted in the housing. Spring 42 presses the latch to its extended or operative position shown in FIG. 3 and 10. The latch may be retracted to its inoperative position shown in FIG. 11 against the pressure of spring 42 to release the door.

The latch operator 14 is pivotally mounted in the housing on a vertical pin 44 parallel to pin 26. The latch operator has an operating arm 46, the tip 48 of which engages a surface 50 of the arm 38 of the latch to retract the latch when the latch operator is turned clockwise in FIG. 11 by hand pressure against the handle portion 52 formed on the second arm 54 of the latch operator.

The bolt 16 is an elongated member of generally square cross-section but relieved with slots on opposite sides to receive guide ribs 56 in the housing. The bolt is mounted in the housing for horizontal sliding movement on its longitudinal axis from an extended locking position shown in FIG. 13 in which it projects towards the door jamb for locking engagement in a complimentary recess, not shown, to a retracted position shown in FIG. 12.

The bolt actuator 17 has a hub 60 in the form of a circular disc mounted to turn on its own central horizontal axis which is perpendicular to the pivot pins 26 and 44. The hub 60 is mounted for axial rotation within the sleeve 62. The sleeve has mounting ring portions 64 engaged over studs formed within the mounting portion of the housing and retained thereon when the housing is bolted to the door by being clamped between the surface of the door and the plate 20 of the mounting portion.

The bolt actuator 17 has a ring 70 formed on the hub in concentric relation therewith. Ring 70 projects radially beyond the hub and has a pin 72 near its periphery on one side which extends and engages in a vertical slot 74 formed in the adjacent side of the bolt. The latch operator may be rotated manually by means of a lever 76 projecting radially from the ring 70 through an opening 78 in the housing. When the bolt actuator is in the position of FIGS. 4 and 12, pin 72 retains the bolt in the retracted or inoperative position. Rotation of the bolt to the FIG. 13 position causes pin 72 to move the bolt to its extended position in which it may project into a suitable recess in the door jamb to lock the door.

Figure 13:
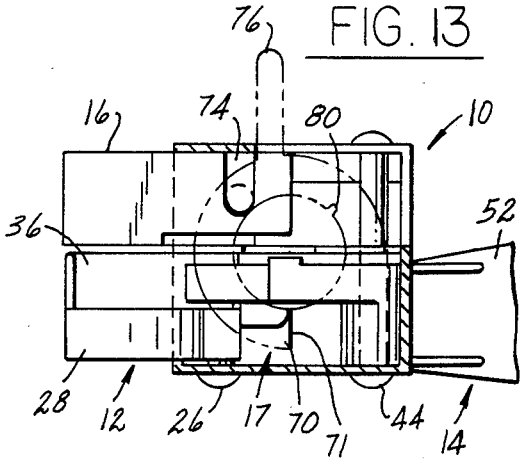
FIG. 13 is similar to FIG. 12 but shows the parts in a different position.
Figure 14:
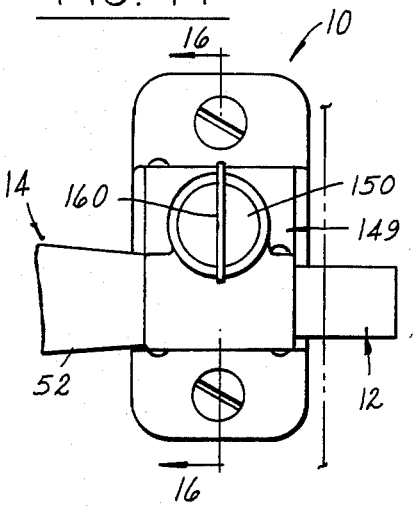
FIG. 14 is an elevational view of a door latch and lock mechanism of modified construction.
Figure 15:
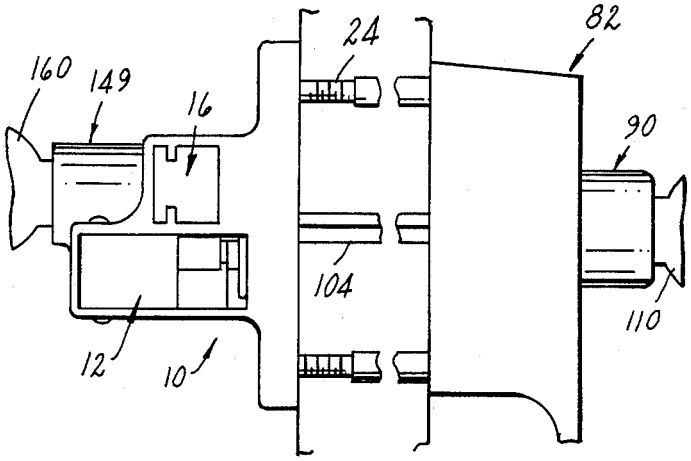
FIG. 15 is an elevational view as seen from the right in FIG. 14, showing also the cooperating mechanism on the outerside of the door.

It will be noted that the ring 70 has an arcuate notch 71 in its outer edge portion of about 90° in extent. The ring is in a plane coinciding with the arcuate peripheral edge 30 of latch 12 (See FIGS. 11 and 13). When the bolt actuator is rotated to extend the bolt, the unnotched portion of the ring 70 extends behind this peripheral edge portion 30 as seen in FIG. 13, positively preventing the latch from being retracted. Hence the door is prevented from being opened not only by the bolt 16 but also by the locked condition of the latch. Hence, the effect is that of a double dead bolt. However, when the bolt operator is turned to the FIG. 12 position, the notch 71 is brought into register with the latch to provide clearance so that the latch can be retracted in the normal way.

The hub 60 of the bolt actuator 17 has a rib 80 on its outer surface adapted to engage in either one of two slots 82 and 84 formed in the mounting sleeve 62. The rib engages in one of these slots in the FIG. 12 position of rotation of the bolt actuator and engages in the other slot when the bolt actuator is turned to the FIG. 13 position. These slots serve as detents to frictionally retain the bolt operator in one or the other of its two positions. Preferably the sleeve 62 is formed of a suitable flexible plastic so that the slots will yield to release the bolt actuator 17 when light manual turning force is applied.

Figure 2:
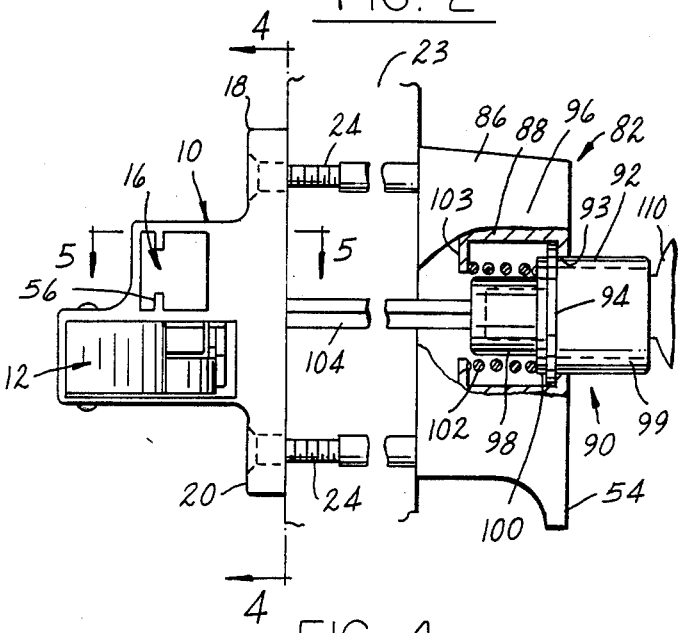
FIG. 2 is an elevational view of the structure shown in FIG. 1 as seen from the right, and also showing the cooperating mechanism mounted on the outer side of the door.
Figure 3:
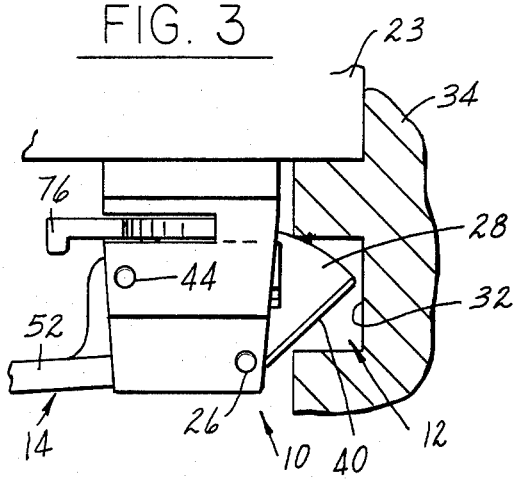
FIG. 3 is a view looking in the direction of the arrow 3 in FIG. 1.
Figure 4:
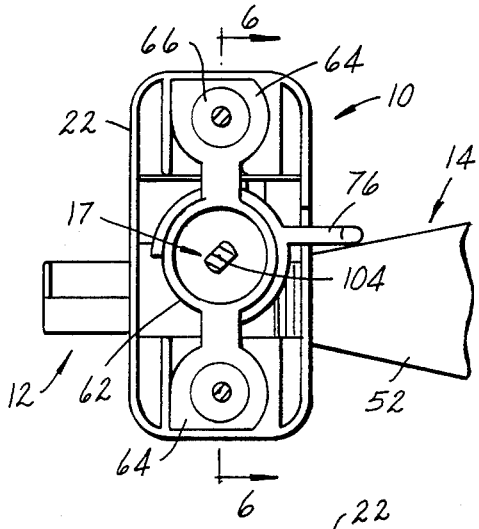
FIG. 4 is a view taken on the line 4—4 in FIG. 2.
Figure 5:
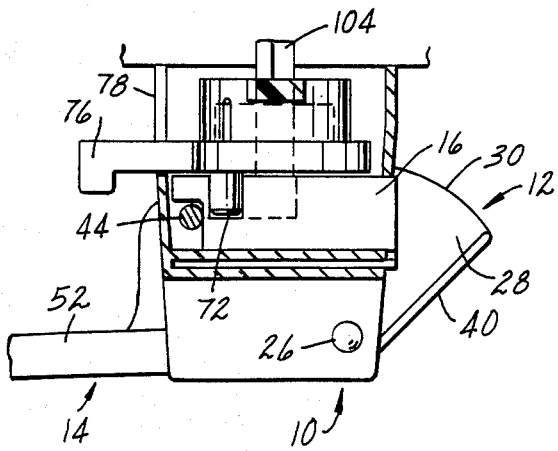
FIG. 5 is a sectional view taken on the line 5—5 in FIG. 2.
Figure 6:
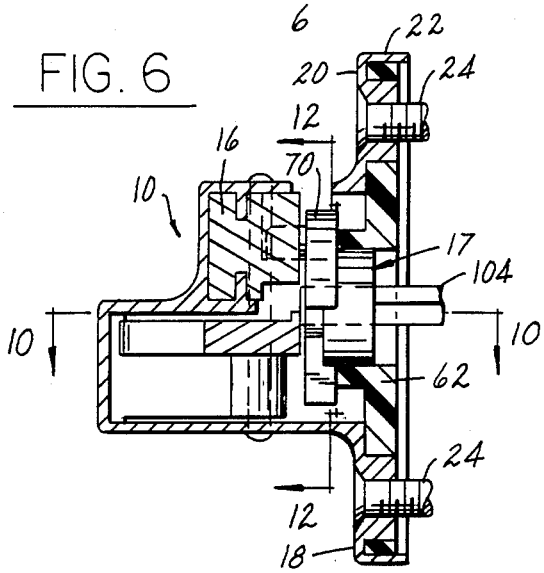
FIG. 6 is a sectional view taken on the line 6—6 in FIG. 4.
Figure 7:
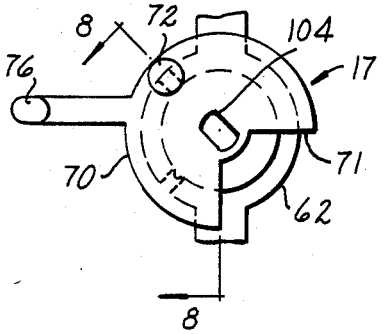
FIG. 7 is a detail view in elevation showing the bolt actuator.
Figure 8:
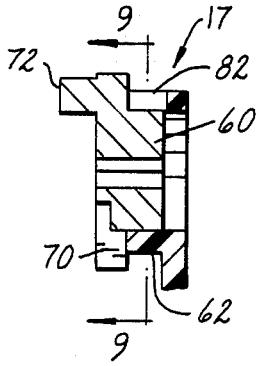
FIG. 8 is a sectional view taken on the line 8—8 in FIG. 7.
Figure 9:
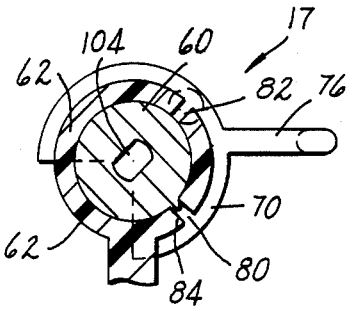
FIG. 9 is a sectional view taken on the line 9—9 in FIG. 8.
Figure 10:
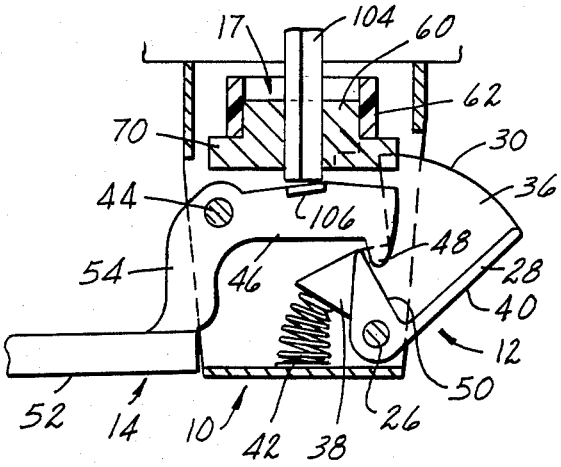
FIG. 10 is a sectional view taken on the line 10—10 in FIG. 6.
Figure 11:
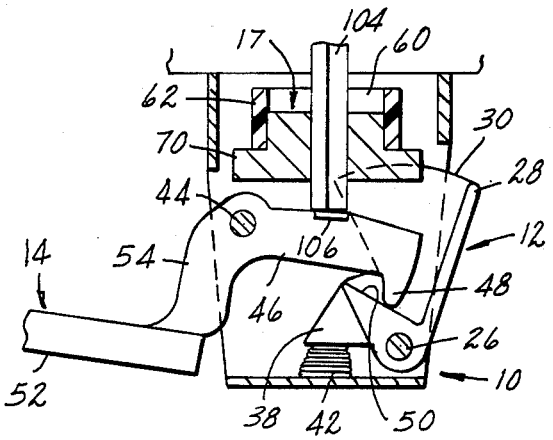
FIG. 11 is similar to FIG. 10 but shows the parts in a different position.
Figure 12:
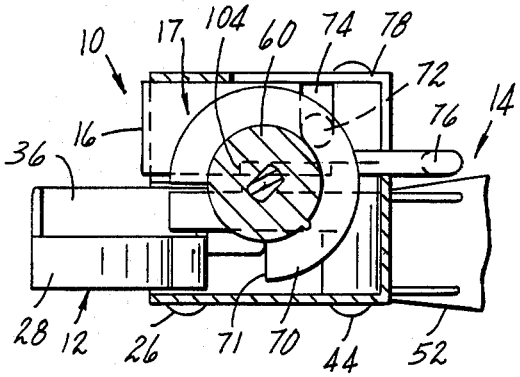
FIG. 12 is a sectional view taken on the line 12—12 in FIG. 6.

Referring to FIG. 2, there is shown complementary mechanism 82 for operating the latch, secured on the outer side of the door by the fasteners 24 engaging studs 83. Mechanism 82 comprises a handle 84 having a hollow portion 86 in which there is installed a frame 88. An operator 90 has a tubular body 92 projecting exteriorly through an opening 93 in the frame with a rectangular flange 94 fitted in the rectangular wall 96 of the frame for axial sliding movement but not rotation. The operator 90 also includes a cylinder 98 within frame 88 which has an end portion 99 fitting rotatably in body 92. A collar 100 on cylinder 98 bears against flange 94 and a coil spring 102 is compressed between the collar and an inturned flange 103 of frame 88. The spring presses the operator 90 to the FIG. 2 position in which flange 94 bears against the wall of the frame surrounding opening 93.

A rod 104 of non-circular cross-section extends from the body 98 of the operator 90 through an opening of similar cross-section at the center of the hub 60 of the bolt actuator 17 and terminates adjacent to the pad 106 on the arm 46 of the latch operator. The bolt actuator 17 may be turned to either of the two positions shown in FIGS. 12 and 13 by rotating the body 98 and rod 104. Rotation of the body 98 is shown as being accomplished by a key 110. However, with the bolt actuator in the FIG. 12 unlocking position, the latch operator 14 may be pivoted to the FIG. 11 position to retract the latch and open the door by pressing on the operator 90 to move it to the left in FIG. 2 against the pressure of spring 102 to advance the rod 104 into contact with pad 106 on the arm 46 of the latch operator.

A modification of the invention is shown in FIGS. 14–19 which is like the first embodiment except that the bolt actuator 17 is turned by a key-operated means rather than by a lever. The elements of construction in the embodiment of FIGS. 14–19 which are like those in the embodiment previously described have been given the same reference characters.

Figure 16:
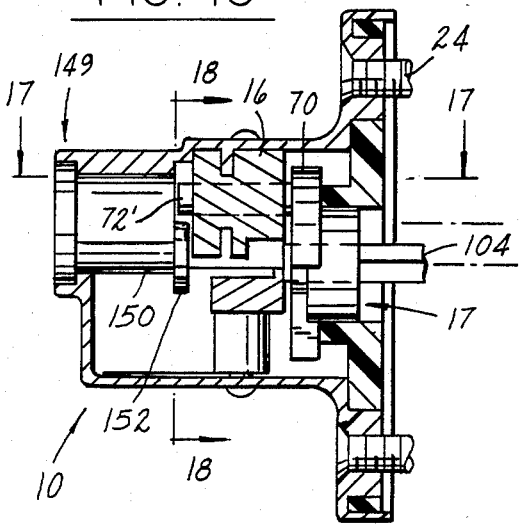
FIG. 16 is a sectional view taken on the line 16—16 in FIG. 14.
Figure 17:
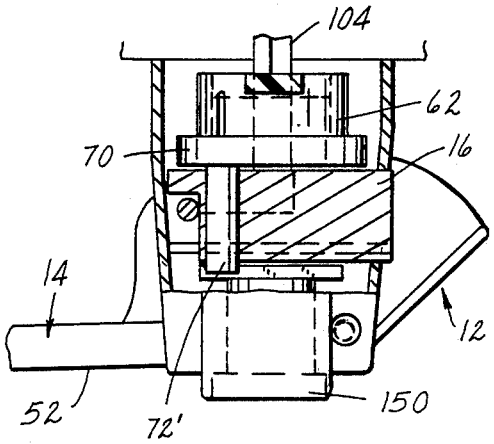
FIG. 17 is a sectional view taken on the line 17—17 in FIG. 16.

Referring particularly to FIGS. 16–17, the pin 72' on the ring 70 of the bolt actuator 17 differs from the pin 72 in FIGS. 1–13 in that it is much longer and extends entirely through and beyond the bolt 16. The slot 74' in the bolt differs from the slot 74 in the previous embodiment in that it is cut all the way through the bolt in order to clear pin 72'. A key-operated mechanism 149 on the inside of the door is carried by the housing 10' and includes a cylinder 150 having a half circular disc 152 on the inner end of the cylinder. Disc 152 is concentric with the cylinder and arranged so that its diametral straight edge 154 is disposed adjacent and to one side of the projecting extremity of the pin 72' of the bolt actuator. The cylinder 150 is operated by a key 160 and when rotated clockwise in FIG. 18 the straight edge 154 of the half disc 152 will engage the projecting end of pin 72' to move it to the FIG. 19 position. At the same time, the bolt will, of course, be extended to the operative position of FIG. 19. In this position of the bolt actuator, the latch is also prevented from being withdrawn from latching position because of the blocking position of the unnotched portion of the ring 70 as shown in FIG. 13. Reverse rotation of the cylinder 150 by the key will return the bolt to its retracted position of FIG. 18 and, of course, the notched portion of the ring 70 of the bolt actuator will clear the latch to permit it to be withdrawn.

Figure 18:
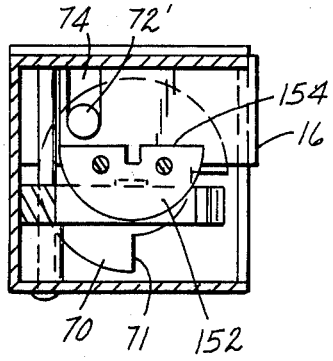
FIG. 18 is a sectional view taken on the line 18—18 in FIG. 16.
Figure 19:
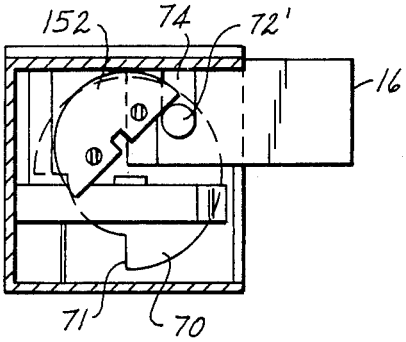
FIG. 19 is similar to FIG. 18 but shows the parts in a different position.

The key operated mechanism 149 will have a spring return (not shown) normally to retain the cylinder in the FIG. 18 position so as not to interfere with the operation of the bolt actuator 17 by the key 110 from the outside of the door.

I claim:

1. A double dead bolt door latch and lock mechanism for a door comprising a housing adapted to be mounted on the door, a latch movably mounted on said housing and when in operative position adapted to engage a keeper to maintain said door closed, an operator mounted on said housing and operable to withdraw said latch from operative position to release said latch from engagement with the keeper and permit the door to be opened, a dead bolt mounted on said housing for movement from an extended operative position engageable with a keeper recess to lock the door in closed position to a retracted inoperative postion, and single means for moving said bolt to its operative position and simultaneously locking said latch in its operative position, said single means comprising an actuator having a pin and slot connection with said bolt and rotatable in one direction to a first position to move said bolt to its extended, operative position and rotatable in the opposite direction to a second position to move said bolt to its retracted, inoperative position, said actuator having a part movable into blocking relation to said latch when said actuator is rotated in said one direction to lock said latch in its operative position, and movable out of blocking relation ot said latch when said actuator is rotated in said opposite direction to permit said latch to be withdrawn, said part of said actuator being a ring for blocking said latch as aforesaid which has a peripheral notch for clearing and unblocking said latch when said actuator is rotated in said opposite direction to said second position.

2. Mechanism as defined in claim 1, including detent means for retaining said actuator in said first and second positions.

3. Mechanism as defined in claim 2, wherein said actuator has a lever for manual rotation thereof.

4. Mechanism as defined in claim 2, wherein said actuator has key-operated means for rotating said actuator.

5. Mechanism as defined in claim 2, wherein said actuator has key-operated means on one side of the door for rotating said actuator, and separate key-operated means on the other side of the door also for rotating said actuator.

6. Mechanism as defined in claim 2, including key-operated means for rotating said actuator comprising an axially movable and rotatable rod, said rod having an axially slidable non-rotatable connection with said actuator to effect rotation of said actuator when said rod is rotated, the tip of said rod being engageable with said operator to operate the latter and withdraw the latch when said rod is moved axially.

7. A double dead bolt door latch and lock mechanism for a door comprising a housing adapted to be mounted on the door, a latch movably mounted on said housing and when in operative position adapted to engage a keeper to maintain said door closed, an operator mounted on said housing and operable to withdraw said latch from operative position to release said latch from engagement with the keeper and permit the door to be opened, a dead bolt mounted on said housing for movement from an extended, operative position engageable with a keeper recess to lock the door in closed position to a retracted inoperative position, and means for moving said bolt to its extended, operative position and simultaneously locking said latch in its operative position comprising an actuator operatively connected to said bolt and movable in one direction to a first position to move said bolt to its extended, operative position and movable in the opposite direction to a second position to move said bolt to its retracted, inoperative position, said actuator having a part movable into blocking relation to said latch when said actuator is moved to said first position to lock said latch in its operative position and prevent it from being withdrawn, and movable out of blocking relation to said latch when said actuator is moved to said second position to permit said latch to be witdrawn.

8. Mechanism as defined in claim 7, wherein said part of said actuator is a member having a first portion for blocking said latch when said actuator is in said first position and having a relieved portion for clearing and unblocking said latch when said actuator is in said second position.

9. Mechanism as defined in claim 7, wherein said actuator is movable by rotation in said one direction and opposite direction to said first and said second positions respectively, and said part of said actuator is a ring for blocking said latch when said actuator is in said first position, said ring having a peripheral notch for clearing and unblocking said latch when said actuator is in said second position.

* * * * *